US011098541B2

(12) United States Patent
Casad et al.

(10) Patent No.: US 11,098,541 B2
(45) Date of Patent: Aug. 24, 2021

(54) POLYCRYSTALLINE-DIAMOND COMPACT AIR BIT

(71) Applicant: Ulterra Drilling Technologies, L.P., Fort Worth, TX (US)

(72) Inventors: Christopher M. Casad, Benbrook, TX (US); Ben Chrest, Holmen, WI (US); Thomas A. Damian, Dallas, TX (US); Carl Aron Deen, Fort Worth, TX (US); Kristy Everheart, Fishers, IN (US); Kerry Sisson, Commerce City, CO (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 405 days.

(21) Appl. No.: 16/147,318

(22) Filed: Sep. 28, 2018

(65) Prior Publication Data

US 2019/0284887 A1 Sep. 19, 2019

Related U.S. Application Data

(60) Provisional application No. 62/644,379, filed on Mar. 16, 2018.

(51) Int. Cl.
*E21B 10/18* (2006.01)
*E21B 10/43* (2006.01)
(Continued)

(52) U.S. Cl.
CPC ..... *E21B 21/16* (2013.01); *E21B 10/18* (2013.01); *E21B 10/42* (2013.01); *E21B 10/43* (2013.01); *E21B 10/55* (2013.01)

(58) Field of Classification Search
CPC ..... E21B 10/18; E21B 10/42; E21B 10/43; E21B 10/55; E21B 21/16;
(Continued)

(56) References Cited

U.S. PATENT DOCUMENTS 4,246,977 A 1/1981 Allen
4,887,677 A 12/1989 Warren et al.
(Continued)

FOREIGN PATENT DOCUMENTS

WO 2013074788 5/2013
WO 2016105882 6/2016

OTHER PUBLICATIONS

International Application No. PCT/US2019/022435, "International Search Report and Written Opinion", dated Jul. 5, 2019, 25 pages.
(Continued)

*Primary Examiner* — Daniel P Stephenson

(74) *Attorney, Agent, or Firm* — Kilpatrick Townsend & Stockton LLP

(57) ABSTRACT

A PDC drill bit for use in downhole air drilling includes a body with a face for engaging a bottom of a hole being drilled and a gauge for engaging a side of the hole being drilled. The face includes a cone, a nose outward of the cone, a shoulder outward of the nose. The bit further includes channels formed in the face of the bit that extend from within the cone to the gauge. The channels define a plurality of blades separated by the channels. Each of the plurality of blades has a leading edge with PDC cutters mounted thereon. One or more of the channels are defined by two side walls and a bottom wall and has a length, width and depth. The width or depth remains substantially constant from a first point on its length within the cone to a second point within the shoulder.

32 Claims, 6 Drawing Sheets

(51) Int. Cl.
*E21B 10/55* (2006.01)
*E21B 21/16* (2006.01)
*E21B 10/42* (2006.01)

(58) Field of Classification Search
CPC .... E21B 2010/425; E21B 10/60; E21B 10/46; E21B 10/48; E21B 10/567; E21B 17/04; E21B 17/10; E21B 17/1092; E21B 21/14
See application file for complete search history.

(56) References Cited

U.S. PATENT DOCUMENTS 5,875,858 A 3/1999 Brady
6,474,425 B1 * 11/2002 Truax ..... E21B 10/26 175/398
7,278,499 B2 * 10/2007 Richert ..... E21B 10/46 175/348
7,703,557 B2 * 4/2010 Durairajan ..... E21B 10/43 175/426
8,191,657 B2 * 6/2012 Richert ..... E21B 10/55 175/431
9,243,458 B2 * 1/2016 Bilen ..... E21B 10/567
10,233,696 B2 * 3/2019 Casad ..... E21B 10/42
10,494,875 B2 * 12/2019 Richert ..... E21B 10/42
2008/0156539 A1 7/2008 Ziegenfuss
2010/0155150 A1 6/2010 Wells et al.
2012/0080230 A1 * 4/2012 Flores ..... F16C 43/04 175/57
2013/0008724 A1 * 1/2013 Endres ..... E21B 10/43 175/431
2018/0002986 A1 1/2018 Zhang et al.
2018/0283105 A1 * 10/2018 Thomas ..... E21B 10/26
2019/0284887 A1 * 9/2019 Casad ..... E21B 10/55

OTHER PUBLICATIONS

International Application No. PCT/US2019/022435, "Invitation to Pay Additional Fees and, Where Applicable, Protest Fee", dated May 31, 2019, 16 pages.
International Application No. PCT/US2019/022435, International Preliminary Report on Patentability, dated Oct. 1, 2020, 18 pages.

* cited by examiner

POLYCRYSTALLINE-DIAMOND COMPACT AIR BIT

RELATED APPLICATION

This application claims the benefit of provisional application No. 62/644,379 filed Mar. 16, 2018, the entirety of which is incorporated herein for all purposes.

FIELD OF INVENTION

The invention relates to fixed cutter drag bits for drilling oil and gas wells using compressible gases as a circulation medium.

BACKGROUND

Polycrystalline-diamond compact (PDC) bits are a type of rotary drag bit used for boring through subterranean rock formations when drilling oil and natural gas wells. As a PDC bit is rotated, discrete cutting structures affixed to the face of the bit drag across the bottom of the well, scraping or shearing the formation. PDC bits use cutting structures, referred to as "cutters," each having a cutting surface or wear surface comprised of a polycrystalline-diamond compact (PDC), hence the designation "PDC bit."

Each cutter of a rotary drag bit is positioned and oriented on a face of the drag bit so that a portion of it, which may be referred to as its wear surface, engages the earth formation as the bit is being rotated. The cutters are spaced apart on an exterior cutting surface or face of the body of a drill bit in a fixed, predetermined pattern. The cutters are typically arrayed along each of several blades, which are raised ridges extending generally radially from the central axis of the bit, toward the periphery of the face. The cutters along each blade present a predetermined cutting profile to the earth formation, shearing the formation as the bit rotates. A drilling fluid pumped down the drill string, into a central passageway formed in the center of the bit, and then out through ports formed in the face of the bit, both cools the cutters and helps to remove and carry cuttings from between the blades. Conventional methods use liquid drilling fluid that is generally incompressible when employing PDC bits due to erosion issues.

The shearing action of the cutters on the rotary drag bits is substantially different from the crushing action of a roller cone bit, which is another type of bit frequently used for drilling oil and gas wells. Roller cone bits are comprised of two or three cone-shaped cutters that rotate on an axis with an angle that is oblique to the axis of rotation of the drill bit. As the bit is rotated, the cones roll across the bottom of the hole, with the teeth crushing the rock as they pass between the cones and the formation.

Each PDC cutter is fabricated as a discrete piece, separate from the drill bit, by bonding a layer of polycrystalline diamond, sometimes called a crown or diamond table, to a substrate. PDC, though very hard and abrasion resistant, tends to be brittle. The substrate, while still very hard, is tougher, thus improving the impact resistance of the cutter. The substrate is typically made long enough to act as a mounting stud, with a portion of it fitting into a pocket or recess formed in the body of the bit. However, the PDC and the substrate structure can be attached to a metal mounting stud. Because of the processes used for fabricating them, the wear layer and substrate typically have a cylindrical shape, with a relatively thin diamond table bonded to a taller or longer cylinder of substrate material. The resulting composite can be machined or milled to change its shape. However, the PDC layer and substrate are most often used on PDC bits in the cylindrical form in which they are made.

Though the wear surface of a PDC cutter is typically comprised of sintered polycrystalline diamond (either natural or synthetic) exhibiting diamond-to-diamond bonding, polycrystalline cubic boron nitride, wurtzite boron nitride, aggregated diamond nanorods (ADN) or other hard, crystalline materials can be substituted for diamond in at least some application and therefore, for the purposes of the PDC bit described below, should be considered equivalents to polycrystalline diamond compacts. References to "PDC" and polycrystalline diamond ("PCD") should be understood to refer to sintered polycrystalline diamond, cubic boron nitride, wurtzite boron nitride and similar materials, including those that other materials or structure elements that might be used to improve its properties and cutting characteristics, as well as thermally stable varieties in which a metal catalyst has been partially or entirely removed after sintering. Substrates for supporting a PDC wear surface or layer are made, at least in part, from cemented metal carbide, with tungsten carbide being the most common, and may also, for example, include transitional layers in which the metal carbide and diamond are mixed with other elements for improving bonding and reducing stress between the PDC and substrate.

When the body of a cutter is affixed to the face of the drill bit, the body of the cutter occupies a recess or pocket formed in the cutting face. A separate pocket or recess is formed for each cutter when the body is fabricated, and the body of the PDC cutters is then press fitted or brazed in the recess to hold it in place. PDC bits typically have a steel or matrix body which is made by filling a graphite mold with hard particulate matter, such as powdered tungsten, and infiltrating the particulate matter with a metal alloy that forms a matrix in which the particulate matter is suspended.

SUMMARY

The invention pertains generally to adapting fixed cutter rotary drag bits, particularly PDC bits, for advancing boreholes through rock and similar geological formations using a compressible or predominately gas-phase circulating medium instead of conventional drilling fluids.

"Air drilling" uses compressible gases under high pressure, such as air or nitrogen, as a circulating medium instead of a conventional liquid ("drilling fluid" or "mud") to evacuate or "lift" the rock cuttings to the surface. Conventional liquid drilling fluids or "muds" used as a circulating medium when drilling well bores for oil and gas exploration are not compressible and have a much higher density as compared to mediums used for air drilling. The circulating medium used in air drilling is either in a gas phase or in a mixed phase that is comprised predominately of one or more gasses and a liquid phase. The liquid phase may be introduced at the surface or result from liquid encountered in the formation. Examples of mixed phase circulation mediums used in air drilling include foams and mists.

Compressible gas phase and mixed phase circulating mediums can be more effective than conventional drilling fluids at preventing excessive temperatures that could degrade the diamond table on PDC cutters. However, despite this advantage, PDC bits are rarely used for air drilling because air drilling presents problems and challenges for PDC bits.

Representative examples of a PDC drill bit adapted for air drilling described below embody a number of features that alone and in various combinations of two or more of them address one or more problems caused by air drilling, including, for example excessive erosion, particularly on the bit body and cutter substrates, as compared to conventional PDC drill bits used with liquid circulating mediums while also achieving satisfactory evacuation of cuttings from the face of the bit into the well-bore for circulation up to the surface.

In one non-limiting example of an embodiment of an adapted PDC drill bit, a channel or slot formed on a face of the PDC drill bit for evacuating cuttings have a substantially constant cross-sectional area, or one or more substantially constant dimensions, along at least a portion of its lengths within the cone and nose regions of the face. Such a channel geometry is contrary to a conventional teaching, which is that the cross-sectional area of a "junk slot" should be made as large as possible to improve evacuation and reduce the risk of cuttings blocking the channel or not being evacuated. A conventional junk slot therefore typically increases in cross-sectional area as it extends radially from the center of the drill bit in order for the junk slot to accommodate an increasing total quantity of cuttings from the PDC cutters fixed along its length. It is believed that a channel with a substantially constant cross-sectional area downstream from a nozzle emitting a compressible circulating medium air tends to direct air from the nozzle into a confined stream oriented toward the gauge, keeping the compressible medium at a higher pressure rather than a lower pressure due to expansion, while also lowering its velocity due to its compressibility. With less swirling as compared to conventional junk slots, it is capable of achieving acceptable evacuation of cuttings while lessening the risk of air spilling over a blade adjacent the channel, which leads to erosion of the blades and cutter substrates.

In another representative embodiment, each channel or slot on the face of a representative embodiment of a PDC drill bit adapted for air drilling has a closed end near the central axis that does not join with the other channels or slots on the face. The closed end of a channel forces pressured air emitted from a nozzle positioned near the closed end in each channel down the channel and toward the gauge.

In yet another representative example, PDC cutters mounted along a leading edge of a blade adjacent to a channel are more closely spaced than typical to form a wall with their wear surfaces that interferes with the tendency of air spilling out of the channel, between the formation of the blade. Furthermore, inserts may be added below and behind the PDC cutters to disrupt high velocity flow and interfere with air spilling over from a channel adjacent the trailing edge of the blade.

These and other features are described in detail below in connection with non-limiting examples of representatives embodiments of such a PDC bit shown in the accompanying drawings.

DETAILED DESCRIPTION OF EXEMPLARY EMBODIMENTS

In the following description, like numbers refer to like elements. "Air" in the following description refers to a circulating medium that is comprised of any compressible gas, combination of compressible gases, or combination of one or more gases with one or more liquids (a mixed phase) that is used as a circulation medium when drilling bores in geological formations, particularly, but not limited to, drilling oil and gas wells. "Air drilling" refers to such drilling.

Figure 1:
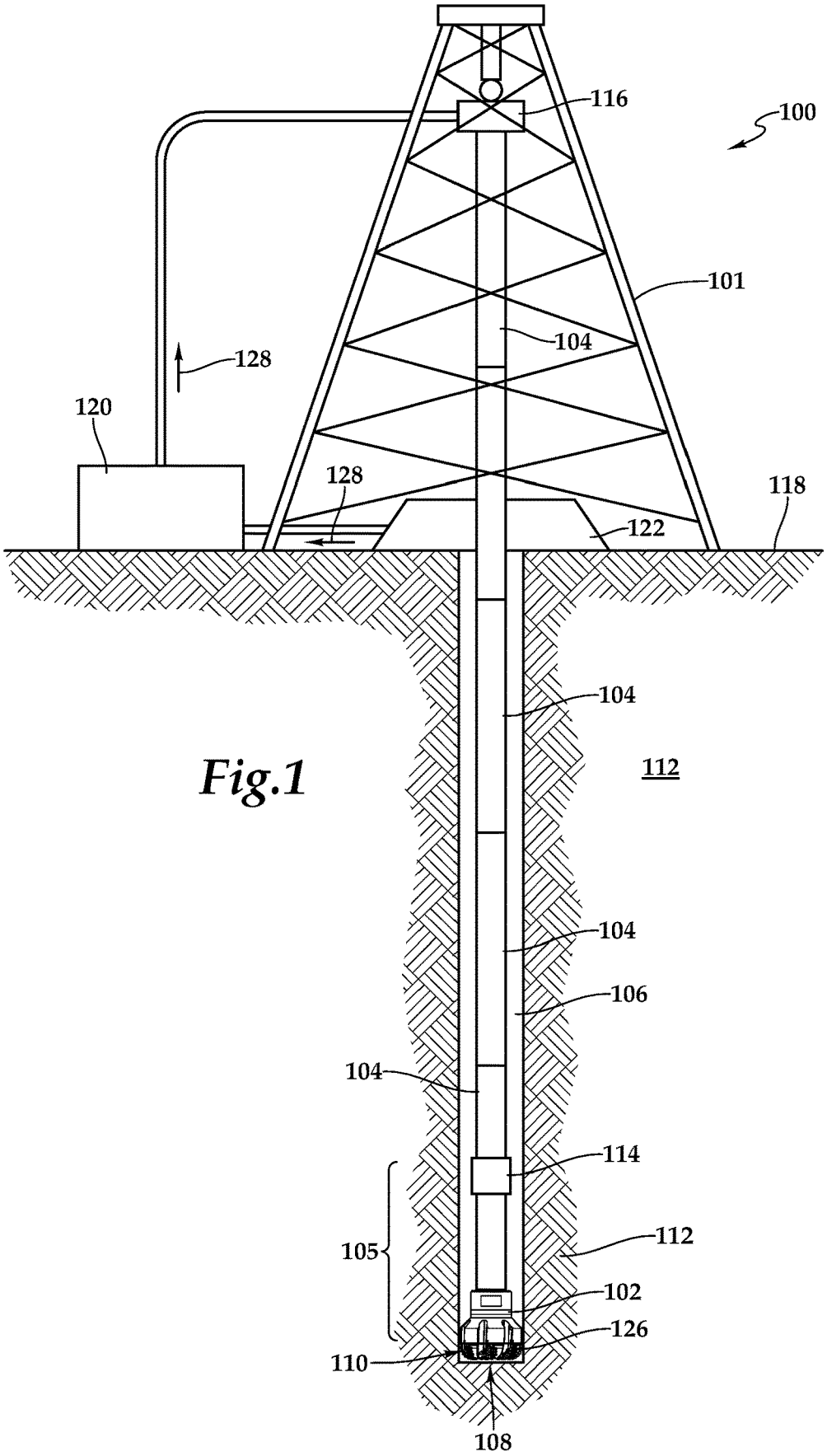
FIG. 1 is a schematic view of an air drilling operation.
Figure 2:
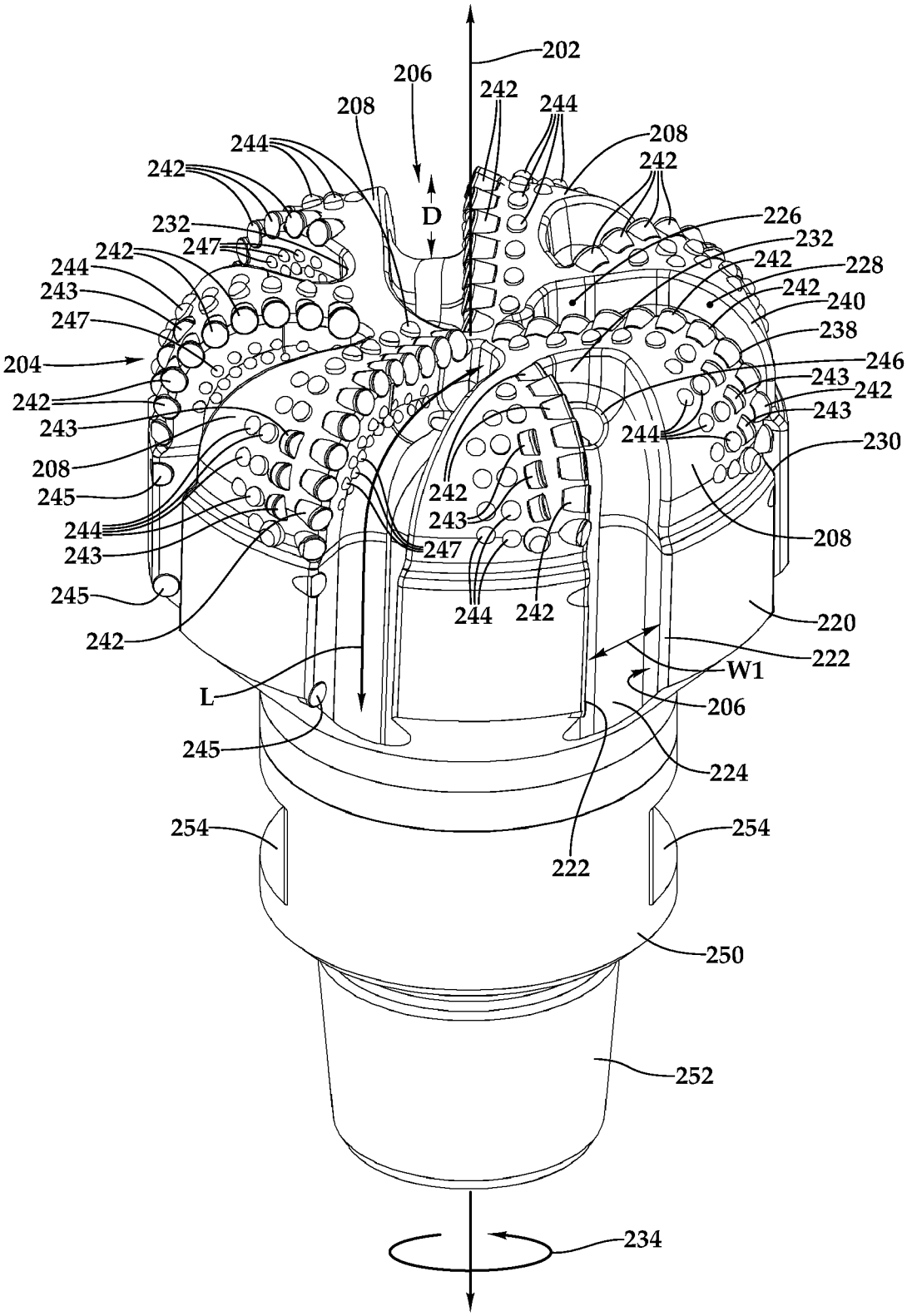
FIG. 2 is a perspective view of a PDC bit for air drilling.
Figure 3:
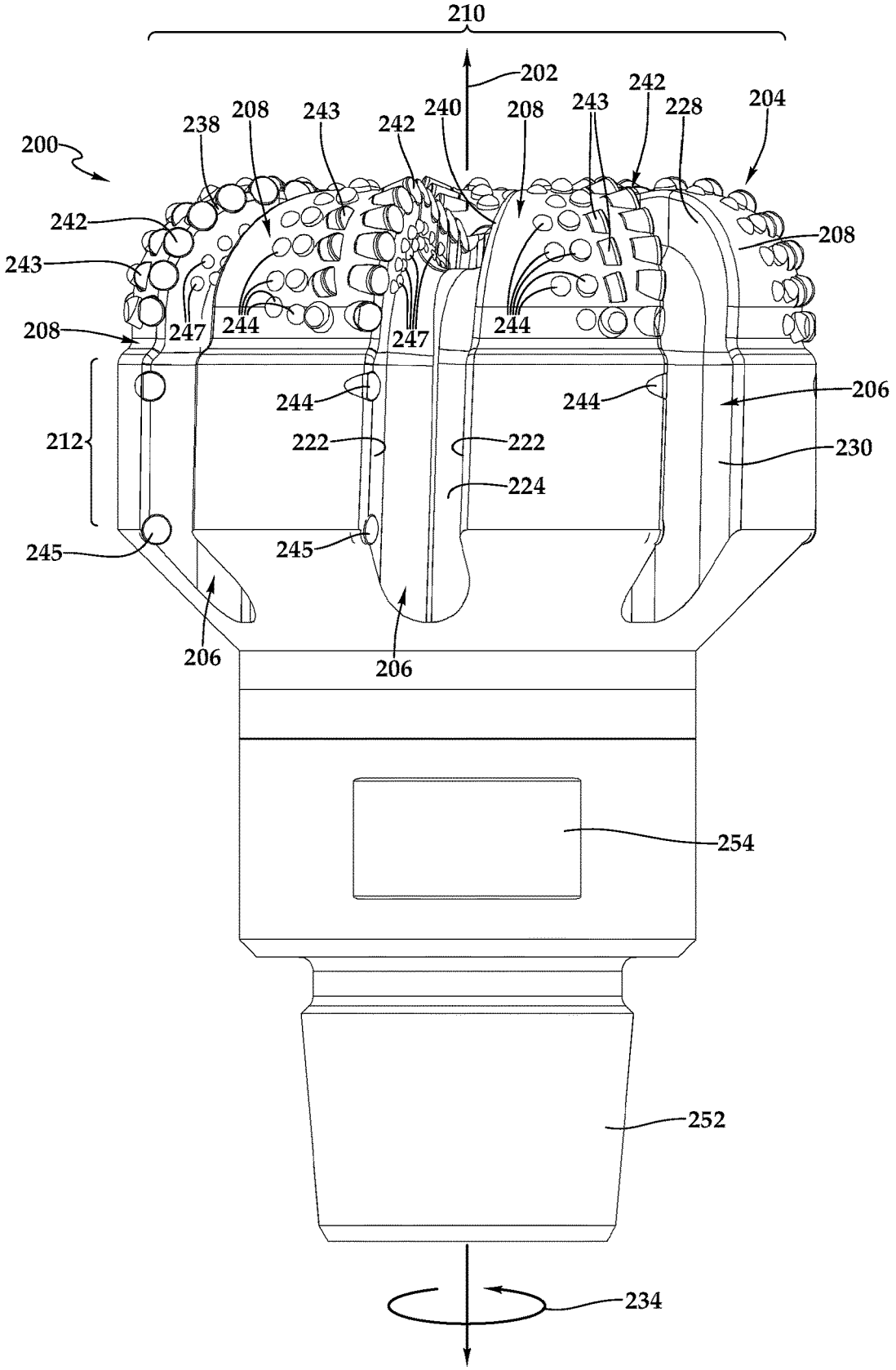
FIG. 3 is a side view of the PDC bit of FIG. 2.
Figure 4:
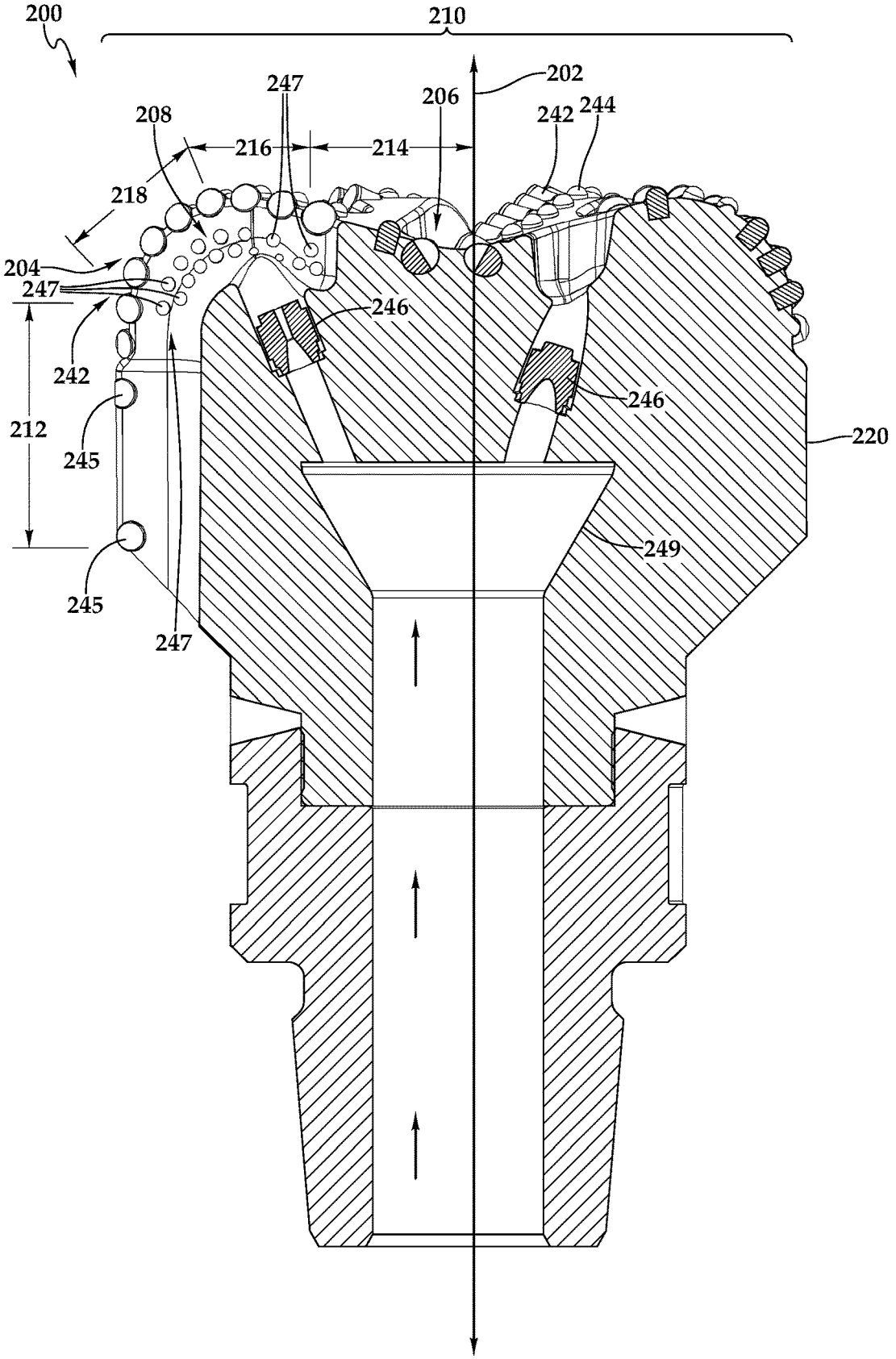
FIG. 4 is a cross-sectional view of the PDC bit taken along section line 4-4 indicated in FIG. 5.
Figure 5:
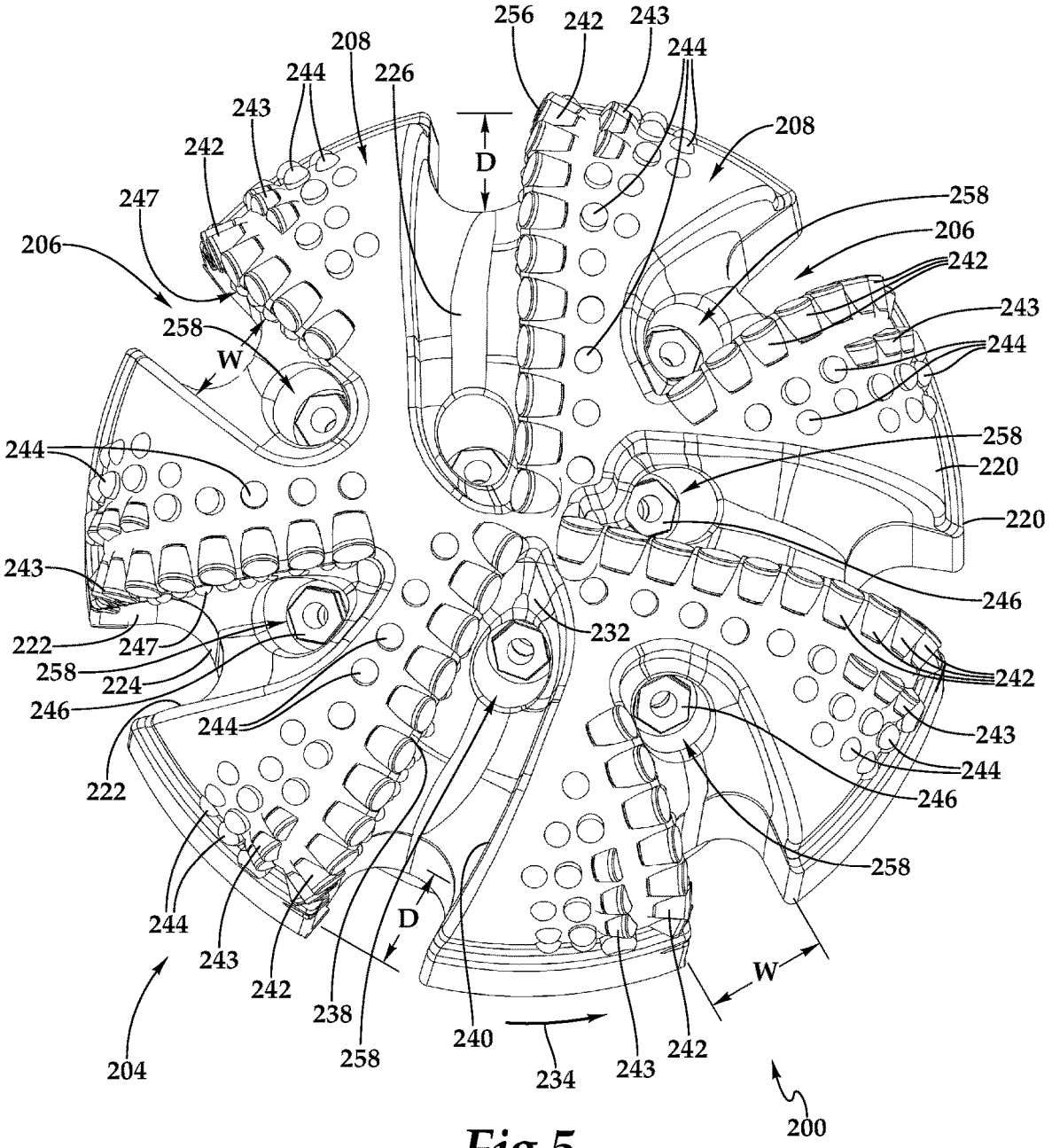
FIG. 5 is a top view of the PDC bit of FIG. 2.

FIG. 1 is a schematic representation of a drilling rig 100 for an air drilling operation. Each of the components that are shown is a schematic representation intended to be generally representative of the component, and the particular example is intended to be a non-limiting, representative example of how a drilling rig might be set up for air drilling. Derick 101 holds drill string 104 within the hole or wellbore 106 that is formed in the rock 112. PDC drill bit 102 is connected to the lower end of the drill string 104 end.

Drill string 104 can be several miles long and, like the well bore, extend in both vertical and horizontal directions from the surface. In this example, the drill string is formed of segments of threaded pipe that is screwed together at the surface as it is lowered into the hole. However, the drill string could also comprise coiled tubing. It may also incorporate components other than pipe or tubing. At the bottom the drill string is a bottom hole assembly (BHA) 105. In addition to the PDC bit 104, a BHA may include, depending on the particular application, one or more of the following: a bit sub, a downhole motor, stabilizers, drill collar, jarring devices, directional drilling and measuring equipment, measurements-while-drilling tools, logging-while-drilling tools and other devices.

The PDC drill bit 102 is rotated to shear the rock 112 and advance the hole. The PDC bit may be rotated in any number of ways. Conventional ways to rotate the PDC drill bit is to rotate drill string with a top drive 116 or table drive (not shown) or with a downhole motor that is part of the BHA 105. The PDC drill bit is surrounded by a sidewall 110 of the well bore.

The pressured "air"—one or more gases—that is used as the circulation medium is delivered to well string 104 from air source 120 of high pressured air represented by arrows 128. High pressure gas can be generated in any number of ways, any of which could be used with a PDC drill bit described herein. For example, the source may comprise one or more high pressure pumps that compresses the air. The air could be possibly atmospheric air but may also include gases from storage tanks (such as liquid nitrogen) that is then vaporized to create high pressure nitrogen gas, which may or may not be further compressed. Air source 120 is intended to be a non-limiting representation any of the possible ways of generating the circulating medium, as the PDC drill bit 102 can be used with any of them.

The compressible circulating medium is circulated downhole by flowing it through the drill string 104, to the PDC bit 102, where it exits through nozzles to carry cuttings away from the face of the PDC drill bit and into the wellbore annulus, where they will carried up to a collection point 122. The air could be recirculated once cleaned of cuttings.

Referring now primarily to FIGS. 2-5, PDC drill bit 200 is a non-limiting, representative example of a PDC drill bit adapted for air drilling. The PDC drill bit is a type a rotary drag bit having a central axis 202 around which the PDC drill bit 200 is intended to rotate during drilling. PDC drill bit 200 is specially configured and adapted to use air as a circulation medium.

The PDC drill bit 200 has a body 204 made from steel or an abrasion-resistant composite material or "matrix" of, for example, tungsten carbide powder and a metal alloy. Parts of the body may also be hard-faced. The body 204 includes the central axis 202, which the body 204 is intended to rotate about during the drilling process. The body 204 includes an outer surface 220, a face or face portion 210 and a gauge 212. The face 210 of the PDC drill bit 200 is the exterior portion of the body 204 intended to face generally in the direction of boring and generally lies in a plane perpendicular to the central axis 202 of the PDC drill bit 200. The face 210 is best viewed in FIG. 5. The face 210 includes a cone region 214 through which the central axis 202 extends, a nose region 216 that is disposed around the central axis 202 outwardly of the cone region 214, and a shoulder region 218 disposed around the central axis 202 outwardly of the nose region 216 and inwardly of the gauge 212.

The PDC drill bit 200 further includes channels 206 formed in the face 210 of the body 204, blades 208 formed or positioned between the plurality of channels 206, and a hydro-pneumatic nozzle 246 positioned in each of the plurality of channels 206.

Each of the channels 206 in this example extend from within the cone region 214, near the central axis 202, at least to, and preferably through, the gauge 212, where it communicates with the annulus of the well bore during drilling. In this example, there are seven channels spaced around the central axis 202. However, there could be more than our less than seven channels. However, with more channels, the width of the channels can be kept relatively narrow, at least as compared to conventional PDC drill bits, while providing sufficient capacity for evacuating cuttings. In this example, each of the channels 206 has a closed end 232 near the central axis and do not connect with any of the other plurality of channels on the face 210. Thus, each of the channels 206 is separate from the other and do not communicate directly with each other during drilling, when the bottom of the hole is close to the face. As a consequence, air discharged from an orifice of the nozzle 246 within a channel will tend to be directed down that channel. Although in this example all of channels on the face are configured in this way, in alternative embodiments a single channel or two or more of the plurality of channels, but not all, can be configured in this way to achieve at least some of the advantage of this configuration.

The channels 206 are defined between two side walls 222, and a bottom wall 224, and a closed or terminating end 232. The closed or terminating end 232 may be referred to as the beginning of the channel 206. The closed end 232 of each of the plurality of channels 206 is within the cone region 214 near the central axis 202.

Each of the plurality of channels 206 can be defined by a length L, a width W, and a depth D. Not all channels have the same length L, widths W or depths D. The width W and the depth D, at a given position along the length L, defines a cross-sectional area. The width and depth can, and do change, within any given channel, and the widths W and depths D along the lengths of each channels are not necessarily the same for each channel. In at least one or more of a plurality of the channels 206 in one embodiment, or at least two or more or plurality of the channels 206 in another embodiment, or all of the channels on the face in yet another embodiment, one or more of the width W, the depth D, and the cross-sectional area A remains substantially constant or uniform from a first point 226 on its length L to a second point 228 on its length L. The cross-sectional shape of each channel in the illustrated embodiment remains relatively constant or uniform as well. Substantially constant or uniform means, in one embodiment, that a particular dimension varies by not more than 50%, in another embodiment by not more than 25%, in another embodiment by not more than 10%, and in yet another embodiment by not more than 5%. In the illustrated embodiment, the cross-sectional shape or geometry of a channel generally resembles a square or rectangle: the sides and bottom are relatively straight, with rounded transitions or corners. However, alternative embodiments may have different cross-sectional shapes, in which case the dimensions of depth and width would be maximum values. Furthermore, in alternate embodiments, it is possible for the cross-sectional shape or geometry to be different at, or to change between, two or more different points along the length of a channel while the cross-sectional area remains substantially constant at those points and, in a particular embodiment, at each point between them.

In the illustrated example, the first point 226 is located within the cone region 214, and the second point 228 is located within the shoulder region 218. However, in another embodiment, the first point can, instead, be located just downstream from the nozzle 246 or nearer to the transition between the cone and nose regions, or in the nose region. In other embodiments, the second point can, instead, be located within one of the nose (if the first point is in the cone region) or the gauge (if the first point is located within one of the cone, nose and shoulder regions.)

In the illustrated embodiment, one or more of the width W, the depth D, or the cross-sectional area of the channels of each of the one or more channels 206 remains substantially constant from the first point 226 to a third point 230 along its length L, with the third point 230 being located in the gauge region 212. In another aspect, both the width W and the depth D of each of the one or more channels 206 remain substantially constant to the third point 230, with the third point 230 been located in the gauge region 212. In some embodiments, the length L, the width W and the depth D of each of the plurality of channels 206 is substantially consistent along a portion of the length L that extends from a point within the cone region 214 to a point within the gauge region 212.

Maintaining a uniform or constant cross-sectional area of a channel 206 inhibits volume expansion of the air discharged from the nozzle 246 in the channel. Inhibiting or reducing volume expansion of the air, which is a gas or compressible fluid, will tend to reduce pressure loss and thus also flow rate. It may also reduce air velocity, swirling and a tendency of the air to flow between the blade and the bottom of the hole during use.

Each of the blades 208, which is defined by or otherwise separated by the two of the channels 206, has a leading edge 238 formed by the intersection of a side wall of a channel forward of or leading the blade channel and a top surface of the blade, and a trailing edge 240, also formed at the intersection of the top surface of the blade and a side wall of the following or trailing channel. Arrow 234 indicates the direction of rotation of the PDC drill bit 200 about the central axis 202

This particular, non-limiting example of a PDC drill bit has both a first row 242 of PDC cutters and a second row 243 of PDC cutters mounted on each blades 208. The first row of cutters 242 are mounted on the leading edge 238 of each blade 208. The second row of cutters 243 are located behind the primary cutters. In this example, the second row cutters are located primarily on the shoulder of the bit. However, in other embodiments, the second row cutters could be omitted or they could instead, or in addition, be placed in the nose and cone regions. In this example, first row of PDC cutters 242 are mounted in a closely spaced arrangement along the leading edge 238 to reduce gaps between them. By reducing gaps between the cutters, less of the leading edge 238 is exposed to air that may leak from the channel and flow between the blade and the bottom of the hole. The close spacing also tends to block such flow, as the primary cutters will be engaging formation. The first row of cutters can be primary cutters and the second row of cutters are secondary or backup cutters. However, this arrangement is not required. Furthermore, primary cutters can be single set or plural set. In the illustrated example, the PDC drill bit also includes PDC cutters 245 mounted on the gauge in a manner that act primarily as wear surfaces.

Each of the PDC cutters is set, in this example, within a recess or pocket (not shown) formed in the face 210 of the PDC drill bit 200. Each of the PDC cutters may each have the same shape or be individually shaped, depending on preferred drilling dynamics. Furthermore, in alternative embodiments, PDC cutters 242 in the first row may be shaped and placed so that they fit together form a composite cutting structure.

The plurality of PDC cutters 242, whether intended as a wear or cutting surface, may be made of a super hard, polycrystalline diamond, or the like, supported by a substrate that forms a mounting stud for placement in each recess formed in its respective blade 208.

In the illustrated example, inserts 244 are mounted on the blades 208 behind the rows of PDC cutters 242 and 243. The inserts may be arranged in one or more rows. Multiple rows are shown. At least some of the inserts 244 may also be placed proximate the trailing edge 240 of each of the blade 208, as they have been in this example. The inserts tend to disrupt or block flow of the pressurized air across the trailing edge of the blades, and from directly impinging on the substrates of the PDC cutters 242 and 243. Disrupting the flow will tend to lower its velocity and thus erosive effect. Each of the channels may also have formed on a side wall bumps 247 for improving air flow down the channel.

The hydro-pneumatic nozzles 246 each have an orifice 258 that is located proximate the closed or terminating end 232 in at least one, two or more, or, in the illustrated example, in each of the one or more channels 206. The nozzle 246 is mounted in the bottom wall 224 of each of the plurality of channels 206 within the cone region 214. Each of the nozzles 246 are positioned near the central axis 202 and oriented to discharge a stream of high pressure air in the channel in which it is located, but in a direction that does not directly impinge on the PDC cutters 242 that are mounted along a top edge of channel. The nozzle 246 is positioned to direct air downstream from the closed end 232 of the channels 206 to evacuate the rock cuttings through and subsequently out of the plurality of channels 206.

In operation, the face 210 of the PDC drill bit 200 engages the bottom 108 of the hole 106 being drilled to advance the hole 106. The gauge 212 of the PDC drill bit 200 engages the side 110 of the hole 106 being drilled. The air is pumped down the drill string, enters plenum 249, which communicates the pressurized air to hydro-pneumatic nozzles 246 that are positioned at the closed end 232 of the channels 206. Each hydro-pneumatic nozzle 246 includes a constriction that forms a high speed jet of air that exits the orifice 258. Each nozzle is oriented to direct the pneumatic fluid, or air, away from the plurality of PDC cutters 242 positioned on the leading edge 238 of the blades 208 and towards a downstream path along the length L of the channels 206.

If two or more channels have substantially the same geometries—the width, depth and cross-section area being the substantially same in each channel at each point along their length—the flow down each should be the substantially the same, assuming that the volume and velocity of air from the nozzle in each channel is the same. Because each nozzle 246 gets air from a common source, channels with substantially similar geometries tend to receive the same amount of air. In the illustrated example, all of the channels on the face of the drill bit have substantially similar geometries and work together in the system to manage and control the flow and wear of the air and cuttings. However, alternative embodiments may have few then all of the channels made with substantially the same geometries and shapes.

Additionally, the PDC drill bit 200 is connected to a shank 250 that has a coupling 252 for connecting the PDC drill bit 200 to a drill string. The PDC drill bit 200 may also be connected to a "bit breaker" surface 254 for cooperating with a wrench to tighten and loosen the coupling to the drill string.

Figure 6A:
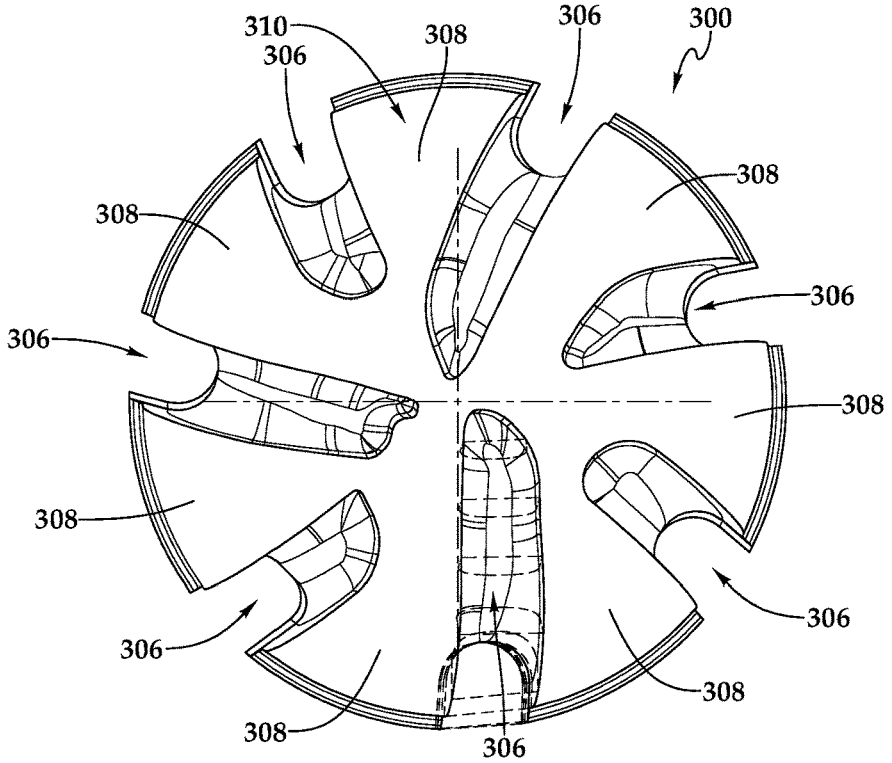
FIG. 6A is a schematic, top view of a PDC bit, for illustrating channel geometries.
Figure 6B:
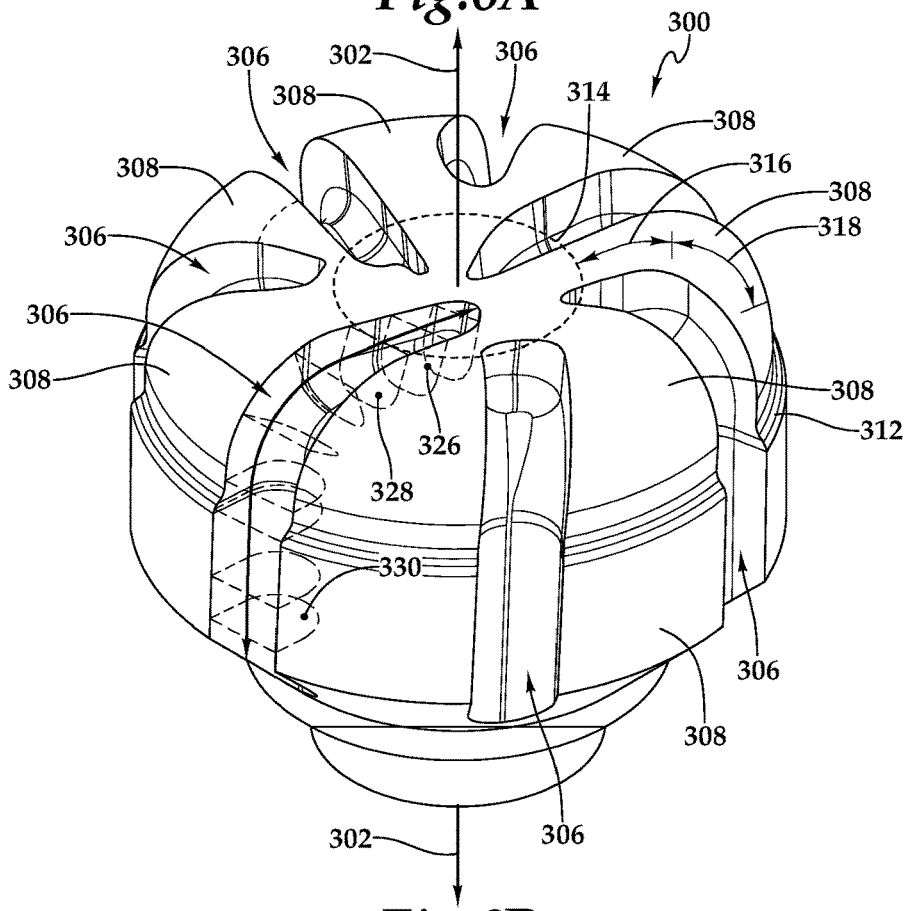
FIG. 6B is a schematic, perspective view of the PDC bit of FIG. 6A.

FIGS. 6A and 6B are schematic representations of a body of PDC drill bit, without the cutters and fluid nozzles, to better illustrate channels or slots described above in connection with FIGS. 2-5B. FIG. 6A is top view of the schematically illustrated PDC bit 300 and FIG. 6B is perspective view of the PDC bit 300 of FIG. 6A. The width W, the depth D, and the length L of a plurality of channels 306 formed in the body 304 can be more clearly seen. Similar to the embodiments above, the plurality of channels 306 defines a plurality of blades 308. The body 304 includes a central axis 302, which the body 304 is intended to rotate about during the drilling process. The body 304 includes a face 310 and a gauge 312. The face 310 includes a cone region 314 disposed around the central axis 302, a nose region 316 outward of the cone region 314, and a shoulder region 318 outward of the nose region 316 and inward of the gauge 312.

The width W and the depth D, at a given position along the length L, forms a cross-sectional area. One or more of the width W, depth D, or cross-sectional area of the channels 306 remains substantially constant or uniform from a first point 326 on its length L to a second point 328 on its length L. In the illustrated example, the first point 326 is located within the cone region 314, and the second point 328 is located within the shoulder region 318. One or more of the depth, width and cross-section of the channel between the second point and third point 330 may also remain substantially uniform or constant, the third point 330 located on the gauge of the bit. In alternative embodiments, the first point may be located in the cone or nose, and the second point may be located in one of the nose (unless the first point is located there), shoulder or gauge.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. A polycrystalline-diamond compact (PDC) drill bit for drilling a hole through rock, the bit comprising:

a body having a central axis, around which the bit is intended to rotate when drilling, the body comprising a face portion for engaging a bottom end of a hole being drilled and a gauge for engaging a side of the hole being drilled, the face portion comprising a cone region through which the central axis extends, a nose region disposed around the central axis outwardly of the cone region, a shoulder region disposed around the central axis outwardly of the nose region and inwardly of the gauge;

a plurality of channels formed in the face portion of the bit, extending from within the cone region, near the central axis, to the gauge and defining a plurality of blades separated by the plurality of channels, each of the plurality of blades having a leading edge on which is mounted a plurality of PDC cutters arranged for shearing the bottom of the hole as the bit is rotated about the central axis; and a plurality of fluid outlets, wherein a single one of the plurality of fluid outlets is disposed within each of the plurality of channels;

wherein one or more of the plurality of channels is defined by two side walls and a bottom wall and has a length and a width, a depth, and a cross-sectional area at each point along is its length, and one of the width, depth and cross-sectional area remains substantially constant from a first point on its length located within the cone region to a second point within the shoulder region.

2. The PDC bit of claim 1, wherein both the width and the depth of each of one or more of the plurality of channels remains substantially constant from the first point to the second point.

3. The PDC bit of claim 2, wherein the cross-sectional area of each of the one or more of the plurality of channels remains substantially constant from the first point to the second point.

4. The PDC bit of claim 1, wherein one of the width, the depth, and cross-sectional areas of each of the one or more of the plurality of channels remains constant to a third point along its length located on the gauge.

5. The PDC bit of claim 4, wherein both the cross-sectional area, of each of the one or more of the plurality of channels remain constant to the third point along its length located on the gauge.

6. The PDC bit of claim 1, further comprising a nozzle mounted at a closed end of each of the one or more of the plurality of channels located nearest the central axis.

7. The PDC bit of claim 6, wherein the width of each of the one or more of the plurality of channels remains substantially constant from a downstream side of the nozzle through a remainder of its length within the cone region.

8. The PDC bit of claim 1, wherein the depth of each of the one or more of the plurality of channels is measured from a cutting profile defined by cutting edges of the plurality of PDC cutters to a bottom of the channel.

9. The PDC bit of claim 1, wherein at least some of the fluid outlets comprise a nozzle disposed near a beginning of each of the one or more of the plurality of channels, the nozzle being aimed to direct fluid away from the PDC cutters disposed along the leading edge of the one of the plurality of blades adjacent the channel.

10. The PDC bit of claim 1, wherein each of the plurality of channels has a width, depth, and cross-sectional area that are substantially consistent along a portion of the length extending from a point within the cone region to a point along the gauge.

11. The PDC bit of claim 1, wherein the plurality of channels include all of the channels on the face and each of the plurality of channels has a closed, terminating end near the central axis and is not connected with any of the other of the plurality of channels on the face.

12. A polycrystalline-diamond compact (PDC) drill bit for drilling a hole through rock, the bit comprising:

a body having a central axis, around which the bit is intended to rotate when drilling, the body including a gauge for engaging a side of the hole being drilled and a face for engaging a bottom of the hole being drilled, the face comprising:

a cone region through which the central axis extends, a nose region disposed outward of the cone region, and a shoulder region disposed outward of the nose region;

a plurality of channels formed in at least a portion of the face of the bit and extending radially along the face from within the cone region, wherein each of the plurality of channels is defined by two side walls and a bottom wall and has a length, a width and a depth, and wherein each of two or more of the plurality the channels has cross-sectional area that remains substantially constant from a first point within the cone region and a second point located within the shoulder region;

a plurality of fluid outlets, wherein a single one of the plurality of fluid outlets is disposed within each of the plurality of channels; and a plurality of blades formed between the plurality of channels, each of the plurality of blades having a leading edge on which is mounted a plurality of PDC cutters arranged for shearing the bottom of the hole as the bit is rotated about the central axis.

13. The PDC bit of claim 12, wherein the width and the depth of each of the two more channels of the plurality of channels remains substantially constant along the length of the channel from the first point to the second point.

14. The PDC bit of claim 12, wherein either the width or the depth of each of the two or more of the plurality of channels remains constant to a third point along its length located on the gauge.

15. The PDC bit of claim 12, further comprising one or more rows of a plurality of inserts positioned on at least one of the plurality of blades, wherein two or more of the inserts are proximate a trailing edge of each of the at least one of the plurality of blades.

16. The PDC bit of claim 12, further comprising a plurality of inserts on the plurality of blades, wherein at least some of the plurality of inserts are positioned behind the plurality of PDC cutters between the leading edge and a trailing edge of each of the plurality of blades.

17. A system for drilling a hole through rock, the system comprising:

a polycrystalline-diamond compact (PDC) drill bit, the bit comprising:

a body made from an abrasion-resistant composite material and having a central axis, around which the bit is intended to rotate when drilling, the body comprising a face for engaging a bottom of the hole being drilled and a gauge for engaging a side of the hole being drilled, the face comprising a cone region through which the central axis extends, a nose region disposed around the central axis outwardly of the cone region, a shoulder region disposed around the central axis outwardly of the nose region and inwardly of the gauge, a plurality of channels formed in the face of the bit, extending from within the cone region, near the central axis, to the gauge and defining a plurality of blades between them, each of the plurality of blades having a leading edge on which is mounted a plurality of PDC cutters for shearing the bottom of the hole as the bit is rotated about the central axis, wherein each of the plurality of channels is defined by two side walls and a bottom wall and has a length, a width and a depth, wherein the plurality of channels each has either a width or a depth that remains substantially constant from a first point on its length located within the cone to a second point within the shoulder region, and a plurality of fluid outlets, wherein a single one of the plurality of fluid outlets is disposed within each of the plurality of channels;

a single fluid outlet mounted in the bottom wall of each of the plurality of channels, each fluid outlet being disposed in the cone region, wherein each fluid outlet is directed downstream in each of the plurality of channels; and a source of a compressible circulation medium configured to provide the compressible circulation medium to each fluid outlet.

18. The system of claim 17, further comprising a plurality of inserts on each of the plurality of blades, wherein at least some of the inserts are proximate a trailing edge of each of the plurality of blades.

19. The system of claim 17, further comprising a plurality of inserts on the plurality of blades, wherein at least some of the plurality of inserts are positioned behind the plurality of PDC cutters, between the leading edge and a trailing edge of each of the plurality of blades.

20. The system of claim 19, wherein the plurality of inserts on the plurality of blades is configured to interfere with any flow over the blades of any of the compressible circulating medium that escapes the plurality of channels.

21. The system of claim 17, wherein the plurality of PDC cutters on the leading edge of at least some of the plurality of blades in the cone region are spaced apart by a distance that reduces exposure of the leading edge to a flow of the compressible circulation medium between the face and formation.

22. A polycrystalline-diamond compact (PDC) drill bit for drilling a hole through rock, the bit comprising:

a body having a central axis, around which the bit is intended to rotate when drilling, the body including a gauge for engaging a side of the hole being drilled and a face for engaging a bottom of the hole being drilled, the face comprising:

a cone region through which the central axis extends, a nose region disposed outward of the cone region, and a shoulder region disposed outward of the nose region;

a plurality of channels formed in at least a portion of the face of the bit and extending along the face of the bit from within the cone region, wherein each of the plurality of channels has a length and, at each point along its length, a width, a depth and cross-sectional area, and wherein at least one of the cross-sectional area, width and depth of each of two or more of the plurality the channels remains substantially constant from a first point within the cone region and a second point located at least within the shoulder region;

a plurality of blades formed between the plurality of channels, each of the plurality of blades having a leading edge and a trailing edge, a plurality of PDC cutters being mounted on the leading edge and arranged for shearing the bottom of the hole as the bit is rotated about the central axis, and a plurality of inserts mounted on the plurality of blades, at least some of the plurality of inserts being positioned behind the plurality of PDC cutters; and a single fluid outlet mounted in a bottom wall of each of the plurality of channels within the cone region, each fluid outlet being directed downstream of each of the plurality of channels and configured to discharge a compressible circulation medium into each of the plurality of channels to evacuate the rock cuttings;

wherein the PDC cutters on the leading edge within the cone region are spaced apart by a distance that reduces exposure of the leading edge to a flow of the compressible circulation medium; and wherein the plurality of inserts is arranged to interfere with any flow over the plurality of blades of any of the compressible circulation medium that escapes the plurality of channels.

23. A method for drilling a hole through rock with a polycrystalline-diamond compact (PDC) drill bit, the PDC drill bit comprising a gauge, a body attached to the gauge, a plurality of channels formed in the body, a plurality of blades separated by the plurality of channels with leading easing having a plurality of PDC cutters mounted along a leading edge; wherein:

the body has a face with a cone region around a central axis of the body, a nose region outward of the cone region, and a shoulder region outward of the nose region;

at least two of the plurality of channels has a closed end within the cone region and extends to at least within the shoulder region, each of the at least two channels having a length and, at each point along its length, a width, a depth, and a cross-sectional flow area and at least one of the cross-sectional area, the width and the depth of each of the at least two channels remains substantially constant from a first point on its length located within the cone region to a second point within the shoulder region; and a single fluid outlet is mounted within each of the at least two channels near the closed of the channel in the cone region;

the method comprising:

rotating the PDC drill bit about its central axis to cause the plurality of PDC cutters to shear rock to form rock cuttings, the rock cuttings falling into the plurality of channels; and pumping a compressible circulation medium through the fluid outlet mounted in a bottom wall of each of the plurality of channels to evacuate the rock cuttings from the plurality of channels.

24. The method of claim 23, wherein both the width and the depth of each of the at least two channels remains substantially constant from the first point to the second point.

25. The method of claim 23, wherein one of the width, the depth, and cross-sectional areas of each of the at least two channels remains constant to a third point along its length located on the gauge.

26. The method of claim 23, wherein the cross-sectional area of each of the least two channels remains substantially constant from the first point to the second point.

27. The method of claim 23, wherein at least some of the fluid outlets comprise a nozzle mounted at a closed end of each of the one or more channels located nearest the central axis.

28. A method for designing a polycrystalline-diamond compact (PDC) drill bit for drilling a hole through rock using a compressible circulation medium, the PDC drill bit having body with central axis about which it will be rotated and comprising:

a gauge for engaging a side of the hole;

a face for engaging a bottom of the hole, the face having a cone region around the central axis, a nose region outward of the cone region, and a shoulder region outward of the nose region;

a plurality of channels formed on at least the face of the body;

a plurality of blades, each having plurality of PDC cutters plurality blades adjacent to one of the plurality of channels;

the method comprising:

determining a geometry for at least two channels of the plurality of channels formed on the body of the PDC drill bit, wherein each of the at least two channels:

extends from within the cone region to past the shoulder region;

has a closed end that is located within the cone region and does not connect with any of the other of the plurality of channels;

is defined by defined by a length extending from the closed end to past the shoulder region, and, at each point along its length, a width, depth, and cross-sectional area, at least one of the width, the depth and the cross-sectional area remaining substantially constant from a first point on its length located within the cone region to a second point within the shoulder region;

for each of the plurality of blades with leading edges adjacent to the at least two channels, placing at least some of the plurality of cutters on along the leading edge; and placing a single fluid outlet within and near the closed end of each of the plurality of channels and orienting each fluid outlet away from the closed end and the PDC cutters mounted along the leading each of the adjacent blade.

29. The method of claim 28, wherein both the width and the depth of each of the at least two channels remains substantially constant from the first point to the second point.

30. The method of claim 28, wherein one of the width, the depth, and cross-sectional areas of each of the at least two channels remains constant to a third point along its length located on the gauge.

31. The method of claim 28, wherein the cross-sectional area of each of the two channels remains substantially constant from the first point to the second point.

32. The method of claim 28, wherein at least some of the fluid outlets comprise a nozzle mounted at a closed end of each of the one or more channels located nearest the central axis.

* * * * *